US005567078A

United States Patent [19]

Lever et al.

[11] Patent Number: 5,567,078

[45] Date of Patent: Oct. 22, 1996

[54] METHOD FOR FORMING A SLOPED FACE ICE CONTROL STRUCTURE

[75] Inventors: James H. Lever, Lebanon; Gordon E. Gooch, Enfield; Edward P. Folton, Meriden, all of N.H.

[73] Assignee: The United States of America as represented by the Secretary of the Army, Washington, D.C.

[21] Appl. No.: 382,695

[22] Filed: Feb. 2, 1995

[51] Int. Cl.[6] ..... B63B 35/08

[52] U.S. Cl. ..... 405/61; 62/260; 405/217; 114/40; 114/41

[58] Field of Search ..... 405/61, 217; 62/260; 114/40, 41, 42

[56] References Cited

U.S. PATENT DOCUMENTS

| | | | |
|---|---|---|---|
| 3,798,912 | 3/1974 | Best et al. | 405/61 |
| 3,881,318 | 5/1975 | Galloway | 405/61 |
| 4,326,822 | 4/1982 | Oshima et al. | 405/217 |
| 4,828,431 | 5/1989 | Chen | 405/217 |
| 5,224,800 | 7/1993 | Mogridge et al. | 405/61 X |

FOREIGN PATENT DOCUMENTS

| | | | |
|---|---|---|---|
| 2545516 | 11/1984 | France | 405/61 |
| 129511 | 1/1989 | Japan | 405/61 |

OTHER PUBLICATIONS

Brachtl, Proceedings of International Symposium on River and Ice, "Ice Control Structures on Slovak Rivers" Int'l Assoc. of Hydraulic Research, Budapest, Hungary, 1974, pp. 149–153.

*Primary Examiner*—Tamara L. Graysay
*Assistant Examiner*—Tara L. Mayo
*Attorney, Agent, or Firm*—Luther A. Marsh

[57] ABSTRACT

The present invention pertains to sloped-faced, ice control elements that are each spaced apart across a riverbed adjacent to a floodplain region. The elements arrest a breakup ice run. The size and spacing of the ice-resisting elements can vary with river size and average ice piece size diameter. The ice-resisting elements, for example, can comprise three or four quarried granite blocks buried in the riverbed in a relatively narrow river of 100 feet or less. This arrangement allows gaps between each ice-resisting element for easy canoe and fish passage. These gaps prevent the ice pieces of the ice jam from passing through during breakup ice runs. The ice-resisting elements may be formed from various materials such as quarried rock, poured concrete, rock-filled cribs, etc. After the ice-resisting elements have retained and stabilized the ice jam, water levels recede and warming water temperatures melt the ice in place behind the ice-resisting elements.

4 Claims, 1 Drawing Sheet

METHOD FOR FORMING A SLOPED FACE ICE CONTROL STRUCTURE

STATEMENT OF GOVERNMENT INTEREST

The invention described herein may be manufactured and used by or for the Government of the United States of America for governmental purposes without the payment of any royalties thereon.

FIELD OF THE INVENTION

This invention pertains to ice stabilizing elements and methods of controlling the movement of ice in rivers.

BACKGROUND OF THE INVENTION

Rain storms in early spring can abruptly break up the ice cover on northern rivers and start it moving rapidly downstream. The broken ice pieces will often lodge against obstructions or stronger ice sheets to form thick ice jams. Ice jams can restrict flow of a river such that water levels can rise 10 feet or more in an hour, often flooding adjacent communities in or near floodplain regions.

Very few methods exist to control breakup ice jams. Large dams with ice retaining piers or tall, closely spaced vertical piers have been proven to arrest a breakup ice run. However, these structures are expensive because they must resist the full load generated by a breakup ice run. In most cases, the cost of such structures exceeds the benefits derived from reduced flooding. They also have the limitations of: i) being extremely intrusive; ii) altering fish habitats by interfering with the natural river flow; and iii) preventing small boat passage, e.g. canoe or small fishing boats. Thus, their use is often unacceptable to other users of the river.

A paper entitled "Ice Control Structures on Slovak Rivers" by Brachtl in *Proceedings of International Symposium on River and Ice*, International Association of Hydraulic Research, Budapest Hungary, 1974, pp. 149–153, teaches of closely spaced inclined piles to stop ice motion caused by hydroplant peaking. These inclined piles prevent thicker ice accumulations further downstream and hence reduce ice-jam flooding caused by hydroplant operation. These inclined piles are particularly useful on regulated rivers that have dam structures. However, ice motion induced by hydroplant peaking is much less severe than that resulting during breakup of an unregulated river where dam structures are not present. Although this teaching provides general explanation of such piling structures, it does not provide a method of using such structures on unregulated rivers or of a durable structural design for withstanding powerful breakup ice runs characteristic of an unregulated river as required by the instant invention. Moreover, this teaching does not teach or suggest of:i) a need for protection of the foundations of an ice-resisting piling structure from scour during breakup ice runs; ii) whether their piling structures can adequately initiate formation of an induced grounded ice jam, an essential feature for reducing loads on an ice-resisting structure as required by the instant invention; and iii) a wide enough spacing between the ice-resisting piling structures which allows passage of small boats as well as river debris during spring flooding. This latter aspect can be the cause of increased spring flood levels upstream from the piles.

Earlier civil structures for control of ice flows include U.S. Pat. 3,798,912 by Best et al. entitled "Artificial Islands and Method of Controlling Ice Movement in Natural or Man-Made Bodies of Water." This patent teaches of man-made structures for placement along river channels for controlling ice flows at harbor entrances. U.S. Pat. 3,881,318 by Galloway entitled "Arctic Barrier Formation" teaches of a method for placement of civil structures in arctic regions for protection of offshore work platforms from ice flows. Neither of U.S. Patents teach or suggest the instant invention's flood prevention technique for use of multiple sloped-face elements in small rivers located near a surrounding floodplain region for protection of a nearby town.

Thus, the instant invention below provides a method for creating a retained and stabilized ice jam while allowing water bypass at locations upstreem of a town otherwise prone to flooding.

SUMMARY OF THE INVENTION

The present invention pertains to sloped-face ice-resisting elements that are each spaced apart across a riverbed adjacent to a floodplain region. The elements arrest a breakup ice run. The size and spacing of the ice-resisting elements can vary with river size and average ice piece size diameter. The ice-resisting elements, for example, can comprise three or four quarried granite blocks buried in the riverbed in a relatively narrow river of 100 feet or less. Gaps between elements can be 2–4 times average ice piece diameter. This arrangement allows large gaps between each ice-resisting element for easy canoe and fish passage. Yet, these gaps are small enough to prevent the ice pieces from passing through during breakup ice runs. The ice-resisting elements may be formed from various materials such as quarried rock, poured concrete, rock-filled cribs, etc. The elements arrest the breakup ice run by forming a grounded ice jam. The grounded ice pieces transmit load to the river bed reducing the loads on these elements. After the ice-resisting elements have retained and stabilized the ice jam, water levels recede and warming water temperatures melt the ice in place behind the ice-resisting elements.

OBJECTS OF THE INVENTION

Accordingly, several objects and advantages of the present invention are:

(a) To provide a flexibly designed sloped-face ice-resisting element with sloped-faces of 30°14 60– from vertical which provides for an economical element. The elements can be made very economical using either quarried rock, natural boulders, formed concrete, rock-filled cribs, steel frames or wood frames.

(b) To provide a sloped-face ice-resisting element with inherent overload protection by allowing ice slippage over the top of the element(s) which in turn significantly decreases the maximum over-turning moment of the elements compared with a near vertical pier, thus further reducing structural requirements for a given element.

(c) To provide a multiple grouped sloped-face ice-resisting element with large gaps between the element that allow easy canoe and fish passage, minimizes debris buildup, and minimizes river disturbance during open-water flows.

(d) To provide a sloped-face ice-resisting element that effectively prevents flooding without the need for an upriver dam structure, thus minimizing the disruption of a river's natural flow.

(e) To provide rugged sloped-face elements that initiate a grounded ice jam that in turn reduces the loads on these elements.

Still further advantages will become apparent from consideration of the ensuing detailed description.

DETAILED DESCRIPTION

Figure 1A:
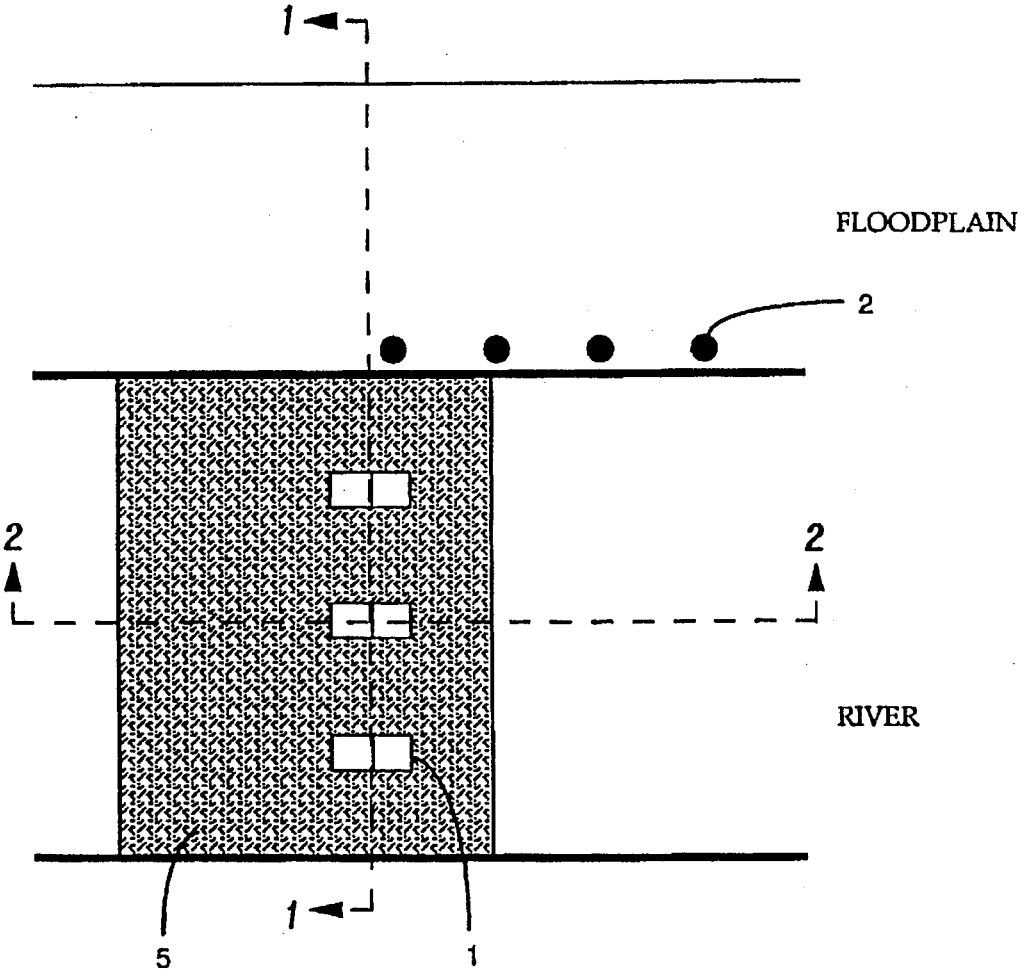
FIG. 1*a* shows a top view of a typical small river next to a floodplain region with the instant inventions sloped-face, ice-resisting elements.
Figure 1B:
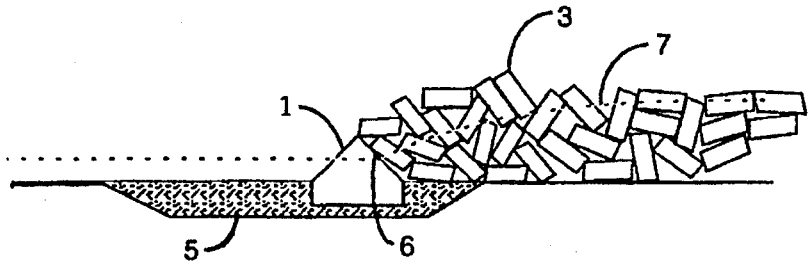
FIG. 1*b* shows a side view through section 1B—1B of FIG. 1*a* with an ice jam shown.
Figure 1C:
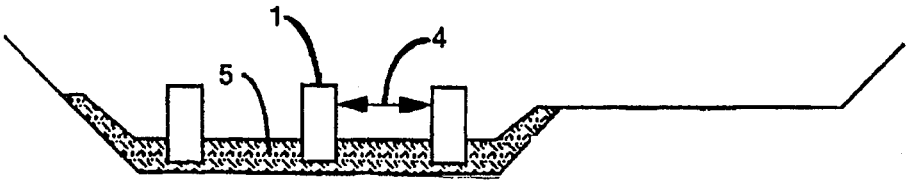
FIG. 1*c* shows another side view of section 1C—1C of FIG. 1*a*.

FIG. 1*a*, 1*b*, 1*c* show the invention in a typical river installation with the appropriate cross-sectional views. The invention uses sloped-face, ice-resisting elements 1 spaced well apart across a riverbed adjacent to a floodplain. The elements 1 arrest the breakup ice run. Riverbank vegetation or boulders 2 retain the ice 3 in the river, and the floodplain bypasses the flow. The size and spacing of the ice-resisting elements 1 can vary with river size. For a typical small river, the elements shown typically would be three 5 feet-wide × 8 feet-tall × 10 foot-long quarried granite blocks buried 3 feet-deep in the riverbed of a 90 feet-wide × 5 feet-deep river. This arrangement allows 14–19 feet gaps 4 between elements 1 for easy canoe and fish passage. Despite these wide gaps, ice pieces cannot easily pass through during breakup ice runs. Instead, they arch between the gaps 4 to initiate a grounded ice jam. The elements 1 my be formed from various materials. Elements 1 are massive constructions that can be made of either quarried rock, poured concrete, or rock-filled cribs. Friction between the elements 1 and the substrate 5 resists the upstream ice loads. If the elements 1 are light, i.e. made of steel or wooden framed structures, they can be anchored with a proper foundation to resist upstream ice loads. The upstream faces 6 of the elements 1 are sloped 30°–60° from vertical, ice 3 impacting an elements 1 generate vertical download to help hold the elements 1 in place. The grounded ice pieces 3 in front of the elements 1 can also help resist ice loads from further upstream. The elements 1 and adjacent riverbanks must be protected from scour caused by high local flows using rip-rap or other suitable protective material 5 that acts as a foundation structure for elements 1. Also, mature trees or small boulders 2 are preferred at the location of the elements 1 along the riverbank to retain ice pieces in the river while allowing water onto the floodplain.

To prevent ice jam flooding, the elements 1 must be constructed at a well chosen site upstream of the natural ice jam site. In operation, moving ice 3 impacts the upstream, sloped-faces 6 of the elements 1 and arches between the gaps 4. This abrupt stoppage of downstream ice motion causes ice pieces to rubble up in front of the elements 1 and ground against the riverbed. Upstream ice impacts this grounded ice causing further rubbling and a propagation of an ice jam in the upstream direction. The grounded ice transmits most of the further increase in hydraulic load to the riverbed. As the ice jam blocks the channel, water level 7 rises and eventually water spills out onto the adjacent floodplain. This acts as a relief valve and helps the elements 1 hold ice throughout the breakup period. The elements 1 thus reduce the volume of ice 3 available to jam and cause flooding downstream near a town. After the ice-resisting elements 1 have retained and stabilized the ice jam, water levels recede and warming water temperatures melt the ice in place.

Alternative designs include: i) ice-resisting elements 1 being placed in a regular or irregular pattern along a stretch of river rather than being placed in a line across the river; ii) many small ice-resisting elements 1 being used instead of a few large ones. For example, an irregular pattern of many natural boulders would provide a very natural appearance while enhancing fish habitat-and white-water canoeing value of the river; and iii) flexibility in site selection being allowable so long as flow relief is provided. For example, a broad, flat field would allow temporary storage of water and ice similar to the impoundment area of a dam. This impoundment could also be man-made, although it would be more expensive. For flow bypass, tunnels or other man-made channels can be used in place of natural floodplains. The design of these channels must include trees, boulders or man-made elements to retain ice pieces in the river while allowing water through. If ice-resisting elements are distributed along a stretch of river, the resulting ice jam can be sufficiently porous to pass the accompanying water in the river itself without the need for separate flow relief.

Although the description above contains many specificities, these should not be construed as limiting the scope of this invention as set forth in the appended claims, but as merely providing illustration of the presently preferred embodiment of this invention.

We claim:

1. A method for forming a flood preventive barrier along a river for a town prone to flooding by ice jams in floodplain regions comprising the steps of:

locating an upstream construction site: i) upstream of the town, and ii) at locations near the town that are natural floodplains that have land based barriers along the river's shoreline; and constructing multiple artificial ice-resisting elements at spaced apart distances from each other at the upstream construction site, each artificial ice-resisting element comprising materials attached by a foundation to the river's bed and stabilized by rip-rap, spacing between each artificial ice-resisting element being preselected relative to a average ice piece size diameter for the river to induce a retained and stabilized ice jam at the barrier, whereby the artificial ice-resisting elements hold the ice jam throughout a breakup period and reduce the volume of ice available to jam that cause flooding downstream.

2. The method of claim 1 wherein the ice-resisting elements each have an upstream face sloped 30°–60° from vertical and the spacing between each element is about 2–4 times the average ice piece diameter, and the ice-resisting elements are constructed across the river;

whereby the ice jam impacting on the elements generates vertical down-load that additionally stabilize the elements in the river's bed.

3. The method of claim 1 wherein the ice-resisting elements are made of materials selected from the group consisting of quarried rock, poured concrete and rock-filled cribs.

4. The method of claim 1 wherein the ice-resisting elements are framed structures made of materials selected from the group consisting of steel and wood.

* * * * *

UNITED STATES PATENT AND TRADEMARK OFFICE

CERTIFICATE OF CORRECTION

PATENT NO. : 5,567,078

DATED : October 22, 1996

INVENTOR(S) : James H. Lever, et al

It is certified that error appears in the above-indentified patent and that said Letters Patent is hereby corrected as shown below:

On the Title Page, Item [75], "Folton" should read —Foltyn—.

Signed and Sealed this

Eighteenth Day of February, 1997

*Attest:*

*Attesting Officer*

BRUCE LEHMAN

*Commissioner of Patents and Trademarks*